United States Patent [19]

Ichinose et al.

[11] 4,336,163

[45] Jun. 22, 1982

[54] OXIDE NEGATIVE RESISTANCE ELEMENT

[75] Inventors: Noboru Ichinose, Yokohama; Yuhji Yokomizo, Tokyo; Masaki Katsura, Mitaka, all of Japan

[73] Assignee: Tokyo Shibaura Electric Co., Ltd., Kawasaki, Japan

[21] Appl. No.: 797,066

[22] Filed: May 16, 1977

Related U.S. Application Data

[63] Continuation of Ser. No. 486,643, Jul. 8, 1974, abandoned.

[30] Foreign Application Priority Data

Jul. 9, 1973 [JP] Japan ..... 48-76559

[51] Int. Cl.[3] ..... H01B 1/06

[52] U.S. Cl. ..... 252/518; 252/521; 338/20; 338/21

[58] Field of Search ..... 252/518, 521, 63.5; 338/20, 21

[56] References Cited

U.S. PATENT DOCUMENTS

| | | | |
|---|---|---|---|
| 3,089,856 | 5/1963 | Cyr et al. | 252/518 |
| 3,642,664 | 2/1972 | Masuyama et al. | 252/521 |
| 3,658,725 | 4/1972 | Masuyama et al. | 252/521 |
| 3,836,483 | 9/1974 | Ichinose et al. | 252/521 |
| 3,991,340 | 11/1976 | Ichinose et al. | 252/518 |
| 4,094,061 | 6/1978 | Guptal et al. | 252/518 X |

*Primary Examiner*—Joseph L. Schofer
*Assistant Examiner*—J. L. Barr
*Attorney, Agent, or Firm*—Birch, Stewart, Kolasch & Birch

[57] ABSTRACT

An oxide negative resistance element having a main body consisting of a sintered material containing 89.9 to 20 mole % of ZnO, 10.0 to 60 mole % of MgO and 0.1 to 20 mole % of $MnO_2$.

2 Claims, 2 Drawing Figures

OXIDE NEGATIVE RESISTANCE ELEMENT

Figure 1:
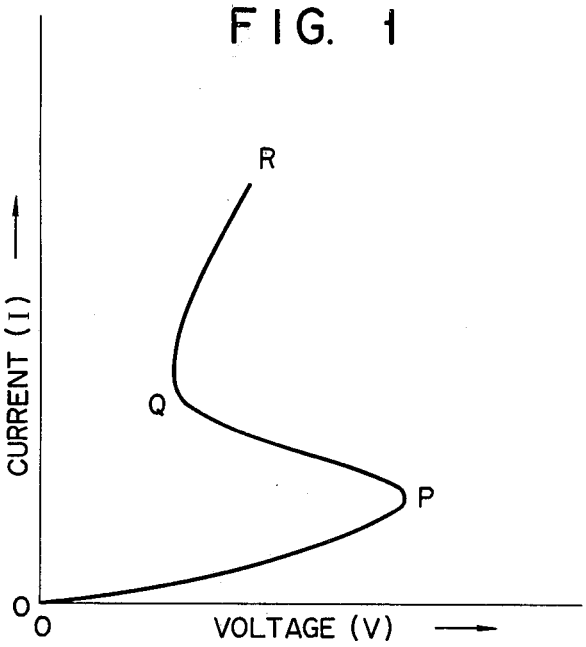

This application is a continuation of copending application Ser. No. 486,643, filed on July 8, 1974, now abandoned.

This invention relates to an oxide negative resistance element having a main body consisting of a sintered material containing ZnO, MgO and $MnO_2$.

The conventional negative resistance element includes the one having an N-shaped negative resistance characteristic such as a dynatron, or the one having an S-shaped negative resistance characteristic such as a discharge tube. Further, the semiconductor negative resistance element includes the one having an N-shaped characteristic such as a pointcontact transistor and a tunnel diode, or the one having an S-shaped characteristic such as a pnpn diode control rectifier and an electron avalanche diode. These semiconductor negative resistance elements do not have a sufficiently high stability relative to, for example, temperature variation, and further have a pn junction requiring a higher level of treatment technique and rendering the manufacturing process complicated, resulting in an increased manufacturing cost. On the other hand, it is also known that an oxide sintered material prepared by adding NiO, CuO and the like to $Fe_2O_3$ or $Fe_3O_4$ presents negative resistance. Since, however, $Fe_2O_3$ or $Fe_3O_4$ is unstable, said oxide sintered material is not sufficient in stability. Further, said oxide sintered material renders complicated the process of manufacturing the negative resistance element, and deteriorates the reproducibility in element manufacture, and threfore is not put to practical use.

Furthermore, a sintered material obtained by adding 0.05 to 15.0 mole % of fluoride such as $MgF_2$, $MnF_2$ or $CdF_2$ to ZnO is also known as one constituting a negative resistance element. Since, however, the fluoride contained in said sintered material is unstable, the element formed of the sintered material has drawbacks in respect of the reproducibility in manufacture and the stability in use, failing to fully meet the requirements when put to practical application. In this case, a sintered material prepared from the addition of oxides to ZnO is the one which has been regarded as presenting no negative resistance.

An object of the invention is to provide an oxide negative resistance element which is easy to manufacture, excellent in respect of the reproducibility in manufacture and the stability in use, and presenting a good S-shaped negative characteristic.

Another object of the invention is to provide an oxide negative resistance element having a main body consisting of a sintered material containing ZnO, MgO and $MnO_2$.

These objects have been attained by an oxide negative resistance element having a main body consisting of a sintered material containing 89.9 to 20 mole % of ZnO, 10.0 to 60 mole % of MgO and 0.1 to 20 mole % of $MnO_2$.

Figure 2:
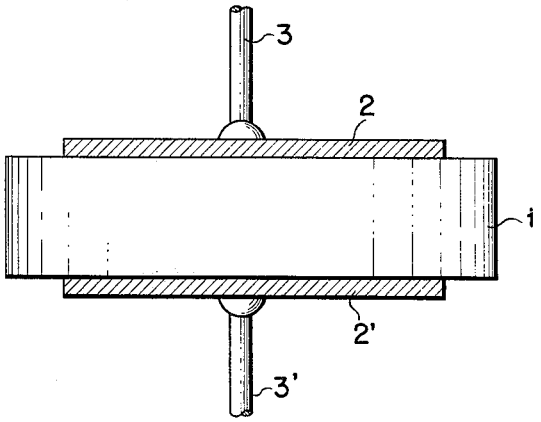

This invention can be more fully understood from the following detailed description when taken in conjunction with the accompanying drawing, in which:

FIG. 1 is a curve diagram illustrating the current-voltage characteristic of a negative resistance element according to the invention; and FIG. 2 is a plan view illustrating the construction of the negative resistance element according to the invention.

As previously stated, the negative resistance element having a main body consisting of a sintered material obtained by adding fluoride to ZnO is known. However, a sintered material obtained by adding oxides such as MgO to ZnO has been deemed as indicative of no negative resistance. The present inventors have found that a negative resistance element having a main body consisting of a sintered material containing 89.9 to 20 mole %, or preferably 78.0 to 36 mole % of ZnO, 10.0 to 60 mole %, or preferably 20.0 to 50 mole % of MgO, and 0.1 to 20 mole %, or preferably 2.0 to 14 mole % of $MnO_2$ presents very good negative resistance characteristics.

Generally, the current-voltage characteristic of an S-shaped negative resistance element presents such a curve as is shown in FIG. 1. In this case, the characteristic of the negative resistance element is represented by a negative resistance factor n expressed by the equation:

$$n = 10 \log \frac{V_p}{V_Q} / \log \frac{I_Q}{I_p}$$

where $V_P$ and $I_P$ respectively represent the voltage and current at a point P of FIG. 1, and $V_Q$ and $I_Q$ similarly respectively represent those at a point Q. n is a factor representing the sharpness degree of a curve OPQ of FIG. 1. The greater the value of n, the better the characteristic, and it is preferred from the practical point of view that n have a value of at least 5.

With regard to the oxide negative resistance element of the invention, when its main body contains 89.9 to 20 mole % of ZnO, 10.0 to 60 mole % of MgO and 0.1 to 20 mole % of $MnO_2$, n has a value of at least 5 whereas when said main body contains 78.0 to 36 mole % of ZnO, 20.0 to 50 mole % of MgO and 2.0 to 14 mole % of $MnO_2$, n has a value of at least 10.

A typical method of manufacturing the aforesaid main body of the negative resistance element is carried out as follows.

Not only the metal oxides, ZnO, MgO and $MnO_2$ but also compounds capable of being converted into the corresponding metal oxides by being heated, such as hydroxide, carbonate, oxalate and the like can be used as raw materials for obtaining the oxide negative resistance element of the invention. The respective powders of these raw materials (for example, ZnO, MgO or $MnO_2$) are so exactly weighed out as to bear a proportion for obtaining a desired sintered material, and are mixed by a proper mixing means, for example, by a ball mill, and thereafter are presintered in a heating oven at a relatively low temperature of, for example, 600° to 900° C. This presintering is required to attain a good reactivity between the respective oxides during sintering and to promote the uniformity of the resultant sintered materials. Particularly where the carbonate is used as the raw material, a prominent shrinkage thereof due to sintering is caused, so that the presintering is necessitated for obtaining a uniform sintered material. Said presintered mass is pulverized by a pulverizer such as a ball mill into powders having a predetermined particle size. A binder is added to these powders, and the resultant mass is shaped at a pressure of approximately 100 kg/cm$^2$ to approximately 1 ton/cm$^2$. The shaped mass may be of a given size depending upon the use of the negative resistance element constituting the final product, and can be, for example, of a disk type approximately 20 mm in diameter and approximately 1 mm in thickness. As the binder there can be used an organic binder such as stearic acid, paraffin, polyvinyl alcohol or polyethylene glycol as well as an inorganic binder such as phosphoric acid.

The sintering is performed in the usual electric furnace at a temperature of approximately 1000° to approximately 1300° C., usually for 1 to 4 hours. The sintering is sufficiently carried out in an air atmosphere.

EXAMPLE

| | |
|---|---|
| ZnO | 90 to 18 mole % |
| MgO | 10.0 to 6 mole % |
| $MnO_2$ | 0 to 22 mole % |

Powdery samples bearing various mixing ratios in the above range were mixed by a ball mill to prepare thirty five samples including controls, as starting materials. These samples were respectively presintered in the air atmosphere by an electric furnace at 800° C. for 1 hour, and the presintered masses were respectively pulverized by the ball mill to obtain thirty five modified powders. Polyvinyl alcohol as a binder was added to these modified powders, and the resultant masses were respectively shaped at a pressure of 0.8 ton/cm$^2$. Thereafter, the shaped powder were charged in the electric furnace kept at 1100° to 1300° C., and were maintained therein for 2 hours and sintered to obtain discs having a diameter of 20 mm and a volume of 0.5 cm$^3$ which are to be formed into a negative resistance element. Mounted on the discs were silver electrodes, thereby preparing a negative resistance element. It is to be noted that where silver baking is effected onto the electrode, the starting material for baking may be of any kind if it becomes silver after being baked, namely it may be metallic silver or $Ag_2O$. Since the resistance element body is excellent in thermal stability, the baking can be effected in a wide temperature range of, for example, 400° to 800° C. The negative resistance element thus obtained is illustrated in FIG. 2. Referring to FIG. 2, reference numeral 1 denotes the negative resistance element body, numerals 2, 2' the electrodes, and numerals 3, 3' the lead wires.

Measurement was made of the voltage-current characteristics of the resultant element samples at room temperature using a standard circuit to determine the respective values of $V_p$, $I_P$, $V_Q$ and n, the results being presented in Table 1 together with the proportions of the sintered materials (negative resistance element bodies).

TABLE 1

| | Proportion (mole %) | | | Characteristics | | | |
|---|---|---|---|---|---|---|---|
| | ZnO | MgO | $MnO_2$ | $V_p$(V) | $I_p$(mA) | $V_Q$(V) | n |
| Control 1 | 90 | 10 | 0 | — | — | — | — |
| 2 | 89.95 | " | 0.05 | 290 | 19 | 240 | 2.5 |
| 3 | " | " | 0.1 | 310 | 17 | 230 | 4.5 |
| 4 | 89.9 | 9 | " | 300 | 17 | 240 | 4.3 |
| 5 | 89.9 | 10 | 0.05 | 295 | 18 | 232 | 3.7 |
| Example 1 | 89.9 | " | 0.1 | 280 | 18 | 135 | 6.3 |
| 2 | 89.0 | " | 1.0 | 275 | 15 | 111 | 7.1 |
| 3 | 85.0 | " | 5.0 | 268 | 14 | 105 | 8.2 |
| 4 | 78.0 | " | 12.0 | 263 | 15 | 124 | 6.9 |
| 5 | 70.0 | " | 20.0 | 254 | 13 | 140 | 5.6 |
| 6 | 79.9 | 20 | 0.1 | 311 | 7 | 117 | 24.0 |
| 7 | 78.0 | " | 2.0 | 298 | 5 | 96 | 48.8 |
| 8 | 73.0 | " | 7.0 | 276 | 6 | 90 | 51.4 |
| 9 | 67.0 | " | 13.0 | 265 | 8 | 133 | 22.6 |
| 10 | 62.0 | " | 18.0 | 254 | 9 | 170 | 13.5 |
| 11 | 69.5 | 30 | 0.5 | 368 | 4 | 173 | 20.1 |

TABLE 1-continued

| | Proportion (mole %) | | | Characteristics | | | |
|---|---|---|---|---|---|---|---|
| | ZnO | MgO | $MnO_2$ | $V_p$(V) | $I_p$(mA) | $V_Q$(V) | n |
| 12 | 62.0 | " | 8.0 | 359 | 4 | 152 | 29.3 |
| 13 | 55.0 | " | 15.0 | 345 | 5 | 199 | 14.2 |
| 14 | 59.7 | 40 | 0.3 | 420 | 4 | 281 | 20.5 |
| 15 | 54.0 | " | 6.0 | 415 | 4 | 204 | 30.6 |
| 16 | 48.0 | " | 12.0 | 408 | 3 | 218 | 23.0 |
| 17 | 44.0 | " | 16.0 | 403 | 3 | 236 | 15.7 |
| 18 | 40.0 | " | 20.0 | 400 | 2 | 277 | 10.4 |
| 19 | 49.0 | 50 | 1.0 | 488 | 5 | 275 | 9.6 |
| 20 | 41.0 | 50 | 9.0 | 477 | 4 | 241 | 15.3 |
| 21 | 36.0 | " | 14.0 | 456 | 3 | 266 | 10.1 |
| 22 | 39.9 | 60 | 0.1 | 553 | 6 | 301 | 5.7 |
| 23 | 35.0 | " | 5.0 | 539 | 5 | 280 | 8.8 |
| 24 | 29.0 | " | 11.0 | 522 | 4 | 287 | 7.6 |
| 25 | 20.0 | " | 20.0 | 511 | 3 | 300 | 5.3 |
| Control 6 | 20.0 | 58 | 22.0 | 509 | 4 | 312 | 3.8 |
| 7 | 20.0 | 60 | 20.0 | 507 | 3 | 318 | 3.6 |
| 8 | 18.0 | 62 | 20.0 | 506 | 4 | 324 | 3.7 |
| 9 | " | " | 22.0 | 507 | 3 | 330 | 3.7 |
| 10 | " | " | 20.0 | 503 | 3 | 341 | 3.4 |

As will be apparent from the above Table 1, the value n of any negative resistance element mainly consisting of a sintered material containing 89.9 to 20 mole % of ZnO, 10.0 to 60 mole % of MgO and 0.1 to 20 mole % of $MnO_2$ is more than 5, whereas in the case of outside the above range the value n of any element obtained is less than 5. Particularly, where ZnO ranges from 78 to 36 mole %, MgO ranges from 20 to 50 mole % and $MnO_2$ ranges from 2.0 to 14 mole %, the value n is excellent in being more than 10.

The load life test (at 70° C. for 1000 hours), temperature characteristic test (at −20° to 60° C.) and aging test (at room temperature for one year) were made on some of the negative resistance elements obtained in the above mentioned Example, the results being presented in Tables 2 to 4.

TABLE 2

| | Load life characteristic | | | | | | |
|---|---|---|---|---|---|---|---|
| | | | | | Rate of change | | |
| Sample | $V_p$(V) | $I_p$(mA) | $V_Q$(V) | n | $\Delta V_p$ (%) | $\Delta V_Q$ (%) | Δn(%) |
| Example 2 | 275 | 15 | 111 | 7.1 | −2.2 | −1.2 | −2.0 |
| Example 8 | 276 | 6 | 90 | 51.4 | −3.0 | −1.6 | −3.0 |
| Example 12 | 359 | 4 | 152 | 29.3 | −1.6 | −1.2 | −2.2 |
| Example 19 | 488 | 5 | 275 | 9.6 | −0.8 | −0.6 | −1.0 |
| Example 24 | 522 | 4 | 287 | 7.6 | −1.1 | −0.8 | −1.5 |

TABLE 3

| | Temperature characteristic | |
|---|---|---|
| Sample | VP(V) | Temperature coefficient (%/C) |
| Example 3 | 268 | −0.03 |
| Example 10 | 254 | −0.01 |
| Example 15 | 415 | −0.02 |
| Example 25 | 511 | −0.04 |

TABLE 4

| | Aging characteristic | |
|---|---|---|
| | n | Rate of change Δn (%) |
| Example 4 | 6.9 | +2.0 |
| Example 4 | 22.6 | +1.3 |
| Example 4 | 20.5 | −0.8 |
| Example 20 | 15.3 | −1.7 |

With respect to the load life test, the rate of change in the negative resistance factor of a conventional ZnObased negative resistance element containing fluoride stands at more than 3% in terms of the absolute value under the same conditions (where the element is allowed to stand 70° C. for 1000 hours) as in this invention. In contrast, as will be apparent from Table 2, said rate of change in the case of the oxide negative resistance element of the invention is as excellent as 3% or less in terms of the absolute value.

Further, with respect to the temperature characteristic of $V_P$, the temperature coefficient of a prior art semiconductor negative resistance element is 0.1%/°C. In contrast, as will be apparent from Table 3, said temperature coefficient of the oxide negative resistance element of the invention is as extremely excellent as less than −0.05%/°C. Further, as will be apparent from Table 4, the time variability of n is as extremely stable as 2% or less in terms of the absolute value.

As above described, the oxide negative resistance element of the invention has many advantages, also from the industrial point of view, that it is extremely excellent in characteristics, inexpensive or easy to manufacture as compared with the prior art negative resistance elements.

What we claim is:

1. A resistance element with a current-voltage characteristic having a range with negative resistance, said element comprising a main body of a sintered oxide material, said body consisting essentially of 89.9 to 20 mole % of ZnO, 10.0 to 60 mole % of MgO, and 0.1 to 20 mole % of $MnO_2$.

2. A resistance element as claimed in claim 1, wherein said main body consists essentially of 78.0 to 36 mole % of ZnO, 20.0 to 50 mole % of MgO and 2.0 to 14 mole % of $MnO_2$.

* * * * *